US007045013B2

(12) United States Patent
DeRegge

(10) Patent No.: US 7,045,013 B2
(45) Date of Patent: May 16, 2006

(54) SPRAY BOOTH SYSTEMS AND METHODS FOR ACCELERATING CURING TIMES

(75) Inventor: Karel DeRegge, Morrison, CO (US)

(73) Assignee: Garmat USA, Englewood, CO (US)

( * ) Notice: Subject to any disclaimer, the term of this patent is extended or adjusted under 35 U.S.C. 154(b) by 0 days.

(21) Appl. No.: 10/956,580

(22) Filed: Oct. 1, 2004

(65) Prior Publication Data

US 2005/0120948 A1 Jun. 9, 2005

Related U.S. Application Data

(60) Provisional application No. 60/530,780, filed on Dec. 17, 2003, provisional application No. 60/526,924, filed on Dec. 3, 2003.

(51) Int. Cl.
*B05B 15/12* (2006.01)
*B05C 15/00* (2006.01)
*F26B 21/06* (2006.01)

(52) U.S. Cl. ..... 118/326; 118/DIG. 7; 454/52; 34/82

(58) Field of Classification Search ..... 118/326, 118/309, DIG. 7; 454/50, 52; 34/82
See application file for complete search history.

(56) References Cited

U.S. PATENT DOCUMENTS 1,745,908 A 2/1930 Paasche
2,132,826 A 10/1938 Ludwig
2,227,481 A 1/1941 Bates
2,257,516 A 9/1941 Roche, Jr. et al.
2,831,550 A 4/1958 Bub
3,568,585 A 3/1971 Voloschen et al.
3,616,744 A 11/1971 Jensen
3,813,856 A 6/1974 Jensen
4,237,780 A 12/1980 Truhan
4,245,551 A 1/1981 Berkmann
4,261,256 A * 4/1981 Joret ..... 454/51
4,285,270 A 8/1981 Donahue
4,515,072 A 5/1985 Crisp
4,522,255 A * 6/1985 Baker ..... 165/48.1
4,584,178 A * 4/1986 Yant et al. ..... 422/140
4,770,118 A 9/1988 Vöhringer et al.

(Continued)

FOREIGN PATENT DOCUMENTS

EP 0006120 A1 1/1980

OTHER PUBLICATIONS

Garmat USA, Brochure for "99700 Series Paint Booths," 2 pages (1998).

(Continued)

*Primary Examiner*—Chris Fiorilla
*Assistant Examiner*—Yewebdar Tadesse
(74) *Attorney, Agent, or Firm*—Townsend and Townsend and Crew LLP

(57) ABSTRACT

One embodiment of the invention provides a spray booth that comprises a spray booth housing having a ceiling and side walls that define an interior for holding an object to be sprayed. A pressurized air plenum is disposed above the ceiling and is adapted to supply air into the interior. A filter media is used to filter air from the plenum before entering into the interior. At least one fan is disposed in the interior below the filter media. The fan is operable to locally increase air flows in the vicinity of the object to increase evaporation rates associated with a spray application on the object, and to enhance air flow over the object during a dry or a cure cycle.

12 Claims, 7 Drawing Sheets

U.S. PATENT DOCUMENTS 4,781,145 A * 11/1988 Amlinsky et al. ..... 118/620
4,827,903 A 5/1989 Kim
4,874,412 A 10/1989 Nowack
4,951,600 A 8/1990 Soshi et al.
5,063,835 A 11/1991 Rockx
5,113,600 A 5/1992 Telchuk
5,178,679 A * 1/1993 Josefsson ..... 118/309
5,352,257 A 10/1994 Powers
5,395,285 A 3/1995 Milton
5,397,394 A 3/1995 Orr
5,456,023 A 10/1995 Farnan
5,473,844 A 12/1995 Martin
5,676,753 A * 10/1997 Josefsson et al. ..... 118/326
5,855,509 A 1/1999 White et al.
5,885,154 A 3/1999 Napadow et al.
6,257,832 B1 * 7/2001 Lyszkowski et al. ..... 417/2
6,264,547 B1 * 7/2001 Walti ..... 454/52
6,533,654 B1 3/2003 DeRegge
6,739,966 B1 5/2004 DeRegge

OTHER PUBLICATIONS

Garmat USA, Brochure for "99877 Series Paint Booths," 2 pages (1998).
Garmat USA, Brochure for "99800 Series Paint Booths," 2 pages (1998).
Garmat USA, Brochure for "The Garmat® Quantum™," 2 pages (1998).
Garmat USA, Brochure for "Closed Top Open Front Spray Booths, 10400 & 10500 Series," 2 pages (1998).
Garmat USA, Brochure for "Sanding Stations" 2 pages (1998).
Garmat USA, Brochure for "Paint Mix Rooms," 2 pages (1998).

* cited by examiner

SPRAY BOOTH SYSTEMS AND METHODS FOR ACCELERATING CURING TIMES

CROSS REFERENCES TO RELATED APPLICATIONS

This application is a nonprovisional application which claims the benefit of U.S. Provisional Application Nos. 60/530,780, filed Dec. 17, 2003, and 60/526,924, filed Dec. 3, 2003, the complete disclosures of which are herein incorporated by reference.

BACKGROUND OF THE INVENTION

This invention relates generally to the field of spray booths, and in particular to spray booths where air is flowed from the ceiling and past the object being sprayed. More specifically, the invention relates to increasing air flow rates around an object being sprayed to increase evaporation rates.

When painting a vehicle or other object, drying or curing times can limit the amount of throughput. One common way to spray a vehicle is by using a spray booth. These booths provide advantages such as reducing particulate, confining paint overspray and evaporated solvents, and reducing drying times. To accelerate drying, air is flowed through the booth and over the vehicle. For waterborne paints, water in the paint travels to the surface to evaporate. As the air flows over the surface of the paint, it tends to enhance evaporation of the water, thereby reducing drying times.

A wide variety of spray booths are in existence. Perhaps the most common types are downdraft and semi-vertical spray booths that use a housing positioned over an open floor grate or an exhaust outlet near the bottom of the walls. Air from the ceiling and any entrained paint overspray and solvents are drawn downward over the vehicle during spraying and drying and are then exhausted through the floor grate or exhaust opening. One example of such a spray booth is described in U.S. Pat. No. 6,533,654, incorporated herein by reference. Typical flow rates may be about 80 to 100 feet per minute over horizontal surfaces. Even at elevated temperatures and a down draft of semi-vertical draft, it can take up to 40 minutes for the entire vehicle to dry sufficiently to permit removal from the spray booth. Until the automobile is dry, it is usually maintained in the spray booth to prevent damage to the soft paint.

To reduce drying times, some have used heaters to increase the temperature within the booth. Others have tried to increase flow rates using nozzles. See, for example, U.S. Pat. No. 5,456,023, the complete disclosure of which is herein incorporated by reference. This invention is related to other techniques for reducing drying and curing times.

BRIEF SUMMARY OF THE INVENTION

One embodiment of the invention provides a spray booth that comprises a spray booth housing having a ceiling and side walls that define an interior for holding an object to be sprayed. A pressurized air plenum is disposed above the ceiling and is adapted to supply air into the interior. A filter media is used to filter air from the plenum before entering into the interior. At least one fan is disposed in the interior below the filter media. The fan is operable to locally increase air flows in the vicinity of the object to increase evaporation rates associated with a spray application on the object, and to enhance air flow over the object during a spray, dry and cure cycle. In this way, enhanced airflows over the object may be achieved without increasing air flows through the plenum. As such drying times may be significantly reduced.

In one aspect, the fan has a low speed setting and a high speed setting. For example, the speed at the low setting may be about 750 RPM and the speed at the high setting be about 1050 RPM. In one process, the low speed setting may be used for spraying applications, and the high speed setting may be used for drying, baking or curing applications. Conveniently, an air motor inside the plenum or an electric motor located outside of the plenum may be used to drive the fan.

At least one exhaust opening may be used to exhaust air from the interior. This may be positioned in a floor of the spray booth, in a pair of towers or in the side walls.

In another aspect, the air plenum may be configured to distribute air across substantially all of the ceiling. Further, the system may use multiple fans, such as two, three or more. This may be operated at the same time, different times, and rotated at the same or different directions. In one arrangement, the fan or fans are configured to produce air flow rates in the range from about 200 feet per minute to about 350 feet per minute around the object. Further, the fan or fans may be configured to produce a flow rate over object is about 100% to about 150% greater than the rest of interior of the spray booth. Also, the fan may be coupled directly under the ceiling filter so that filtered air is flowed over the object.

The invention also provides a method for spraying an object with a spray application. According to the method, an object is placed into the interior of a spray booth, similar to the ones described herein. A spray application is sprayed onto the object, and air is introduced into the interior through the plenum and the filter media. The fan is operated while air flows through the plenum to locally increase air flows within the interior in the vicinity of the object to increase evaporation rates associated with the spray application. Such air flows may also be used during a spray, dry or cure cycle.

In many applications, the object is a vehicle, and the fan is positioned above the vehicle to increase air flow around the vehicle. The flow rate over object may be about 100% to about 150% greater than the rest of interior of the spray booth using fans that generate flow rates of about 200 feet per minute to about 350 feet per minute.

One particular advantage is that the air flows are locally increased within the interior without substantially increasing the pressure within the interior. In this way, the flow within the plenum does not need to be increased to increase evaporation rates. In one aspect, the spray application comprises a waterborne paint, and the increased air flows enhance the evaporation of water from a surface of the waterborne paint. The techniques of the method may be used in essentially any type of spray booth having a downdraft flow or a semi-vertical flow.

DETAILED DESCRIPTION OF THE INVENTION

Aspects of the invention involve increasing air flows around an object being sprayed, baked or cured in a spray booth. The techniques of the invention may be used with essentially any type of down draft of semi-vertical draft system as is known in the art. A few examples of such types of spray booths are described in U.S. Pat. Nos. 6,533,654 and 5,113,600, incorporated herein by reference. However, it will be appreciated that the invention is not intended to be limited only to such spray booths. To increase air flows, the invention uses one or more fans that are positioned directed below the ceiling (which preferably includes filters). In this way, the fans draw the plenum air towards the center of the booth where the object is located. Further, the fans compress and accelerate the air so that more air is forced over the object in the center of the booth, without increasing the supply of air from the plenum. In effect, the same volume of air is used in the booth as a whole, but while in operation, the fans focus more air (which is moving faster) over the object. In some cases, the flow of air from the plenum could actually be reduced, thereby reducing energy costs. Even if the plenum air is not reduced, drying times may be significantly increased with little extra energy requirements, i.e., only the energy needed to run the ceiling fans in the booth. Further, the accelerated air is drawn from the ceiling filters, and is therefore clean air.

The systems and techniques of the invention may be used with essentially any type of refinishing products, including waterborne paints, non-waterborne paints, solvent based patents, clear coats, lacquers, other types of paints, and the like. Hence, the invention is not intended to be limited to a specific type of finishing product.

One particular advantage of such a system is that it can easily be retrofit in essentially any type of existing spray booth where air flows from the ceiling and generally downward or semi-vertically. Further, such a system may be one or more fans, some or all which can be turned on. Also, the fans may be rotated all in the same direction, or some in different directions.

Figure 1:
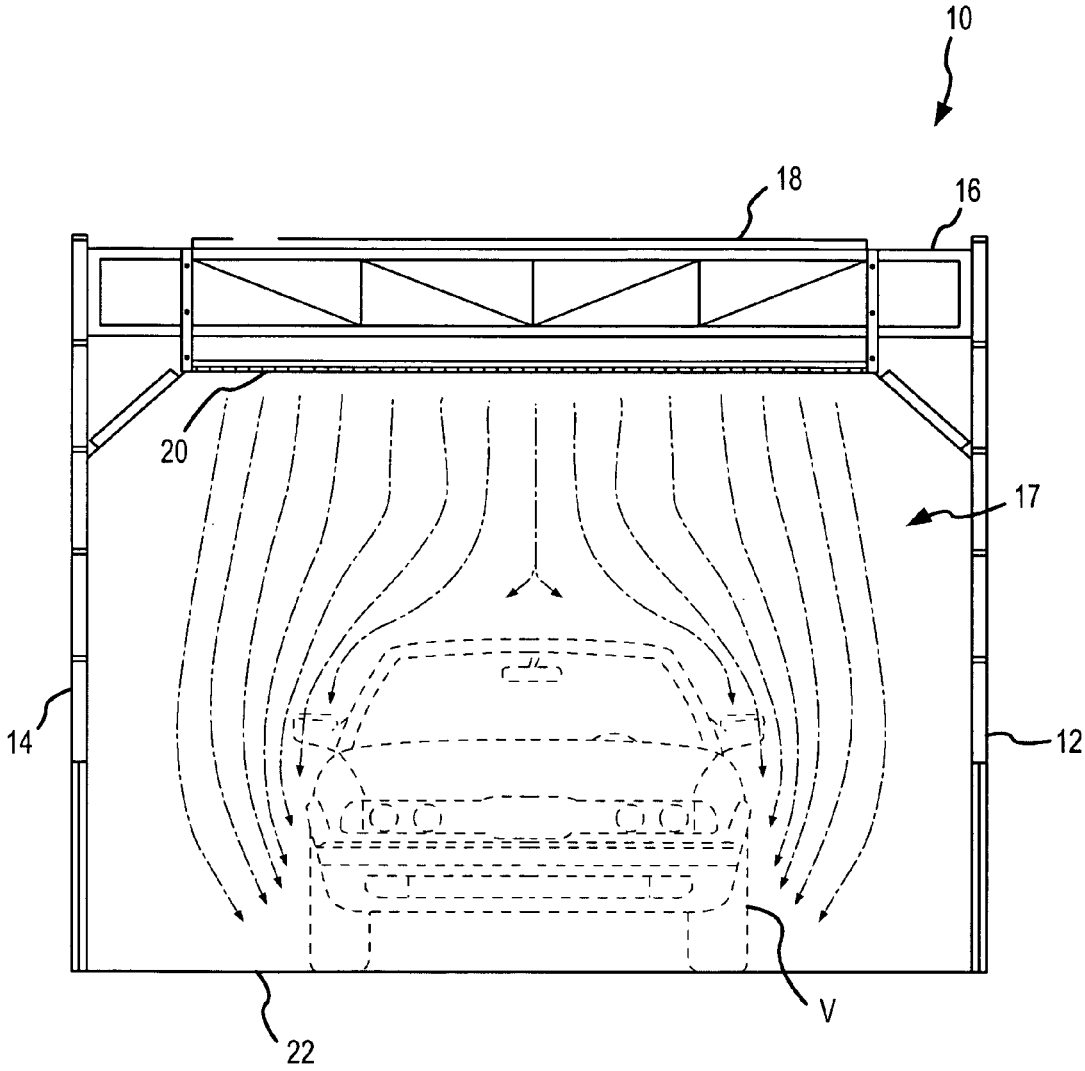
FIG. 1 is a cross sectional front view of a down draft type paint spray booth that may be used with the invention.

FIG. 1 illustrates one embodiment of a down draft spray booth 10 that may be used with the invention. Booth 10 comprises two side walls 12 and 14 and end walls or doors (not shown) as is known in the art. Coupled to walls 12 and 14 is a ceiling 16 that defines an interior 17. Formed in ceiling 16 is a plenum 18 that supplies pressurized air into interior 17 along substantially all of its length. Also formed in ceiling 16 are air filters 20 that filter air passing from plenum 18 into interior 17. Walls rest on a floor 22 which may include a grate through which air and other gases may be exhausted from interior 17. In some cases, the exhaust opening may be included in walls 12 or 14, near floor 22.

In use, a vehicle V is placed into interior 17 and the doors are closed. Pressurized air is provided to plenum 18 where it is filtered by filters 20 and then passes into interior 17. The plenum 18 distributes air across substantially all of its length. This air passes downward as illustrated by the arrows until exhausted through the floor grate.

Figure 2:
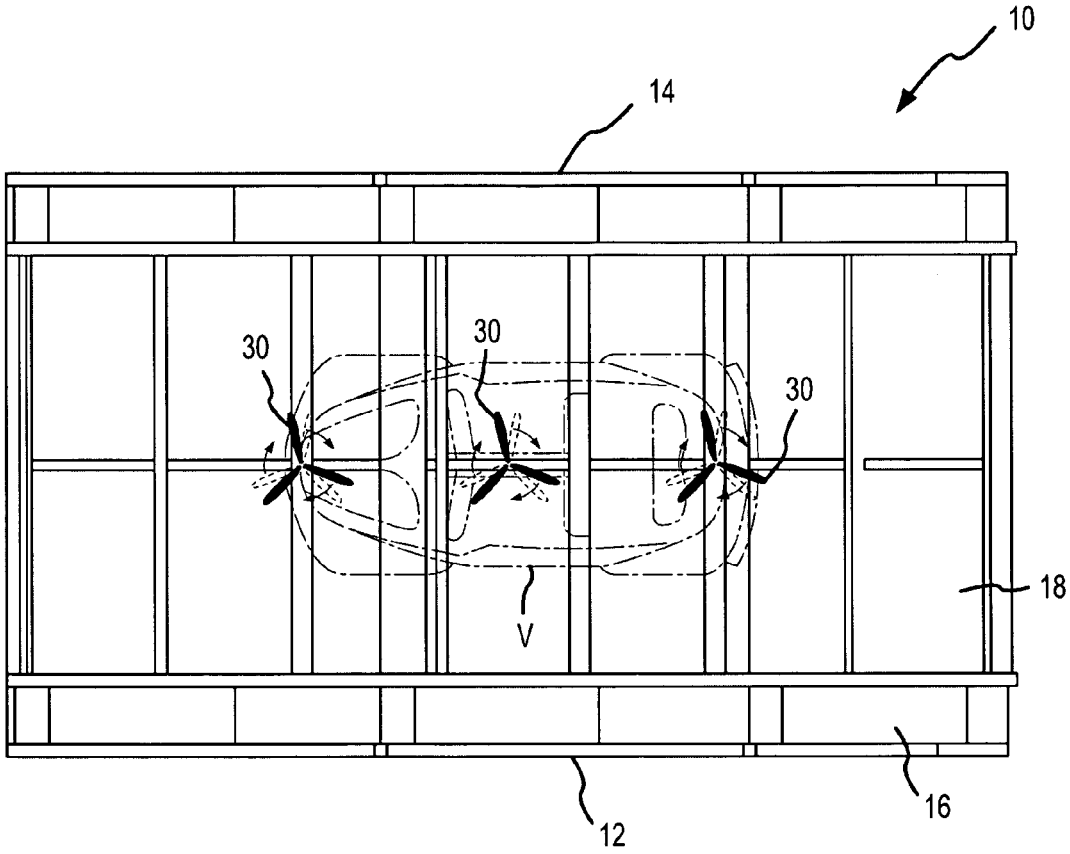
FIG. 2 is a top view of a paint spray booth having propeller fans according to the invention.
Figure 3:
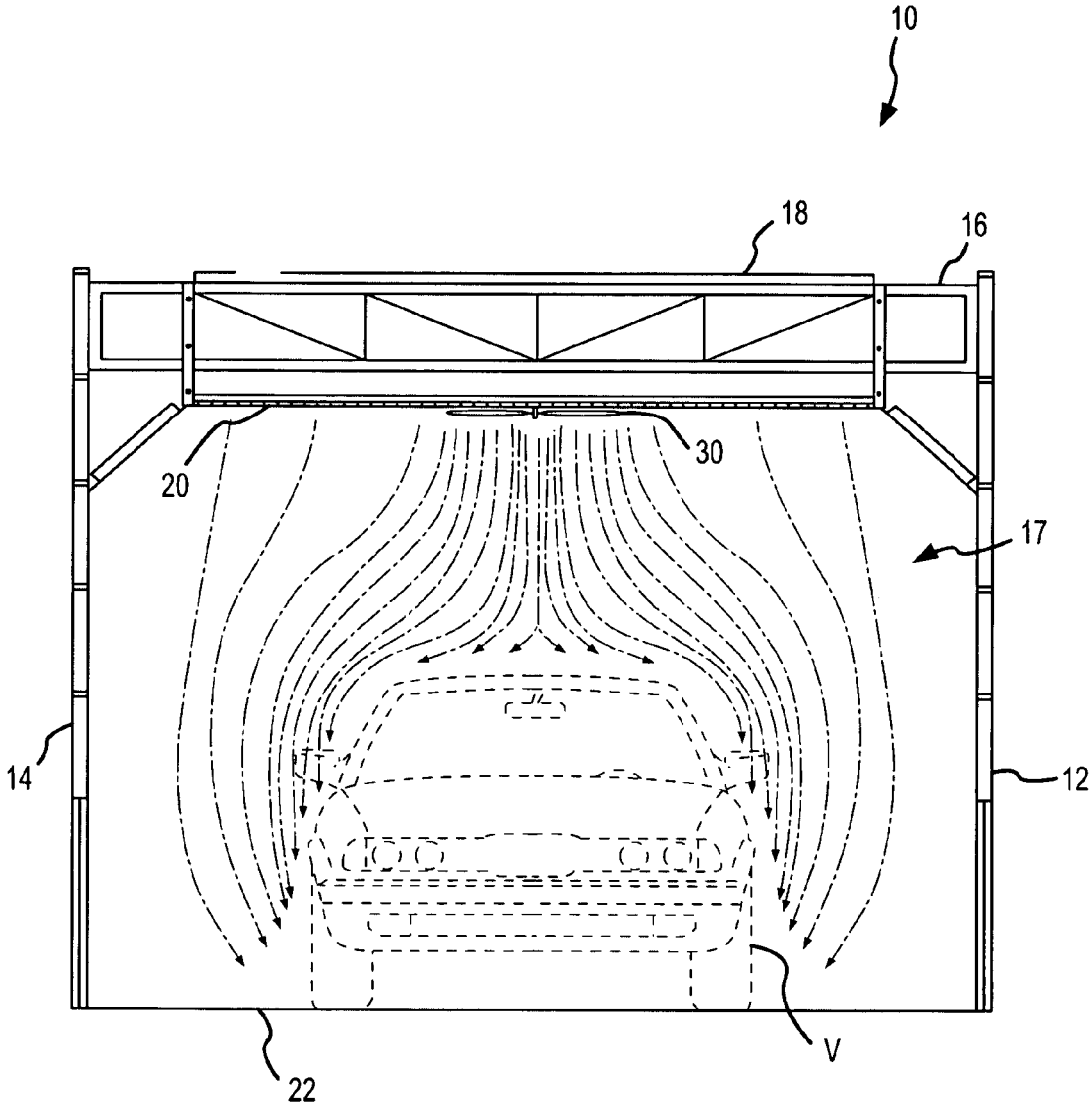
FIG. 3 is a cross sectional front view of the spray booth of FIG. 2.

As shown in FIGS. 2 and 3, booth 10 may be modified to include a set of propeller fans 30 to locally increase air flows around vehicle V. This accelerated air is illustrated by the additional flow lines illustrated in FIG. 3. As illustrated in FIG. 2, the two outside fans are rotated clockwise while the middle fan is rotated counterclockwise. However, it will be appreciated that fans 30 may be rotated differently. Further, not all of fans 30 need to be rotated. Also, although three fans are shown, other numbers of fans may be used as well.

In operation, fans 30 serve to compress and accelerate the air over vehicle V without substantially increasing the pressure within interior 17. In this way, the pressurized (and sometimes heated) air supplied to plenum does not need to be increased while the air flow around vehicle V is substantially increased. As such, additional heated air (which can be expensive) is not needed in interior 17. For example, the amount of air passing over object may be about 100% to about 150% greater than if no fan is used.

Fans 30 may be operated at a low speed setting and a high speed setting (such as while spraying or while curing or baking). The low speed setting may be in the range from about 500 rpm to about 1,000 rpm, and the high speed setting may be in the range from about 500 rpm to about 2,000 rpm.

Figure 4:
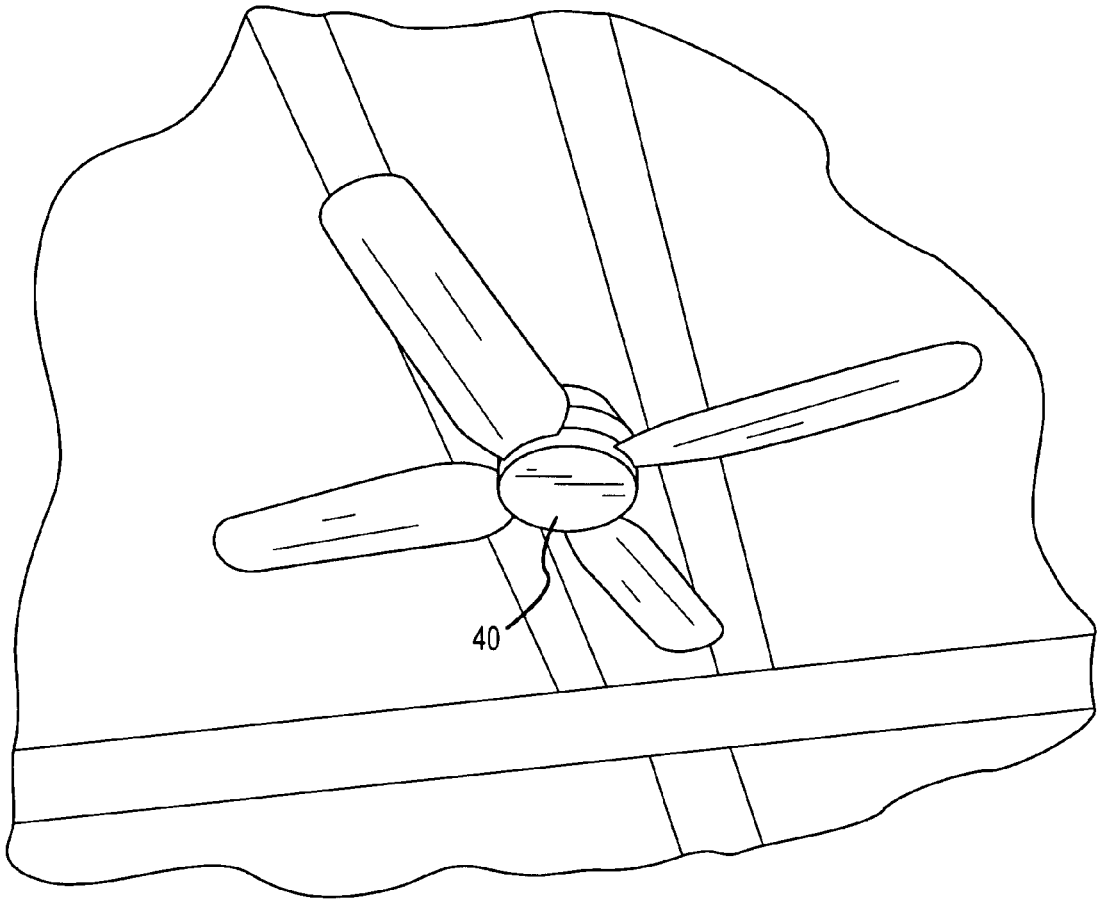
FIG. 4 illustrates one embodiment of a propeller fan according to the invention.

Illustrated in FIG. 4 is one embodiment of a fan 40 that may be used to increase air flows. Fan 40 comprises a plurality of blades that are rotated by a motor (that is typically located outside of the spray booth). This may be an air driven fan, an electric fan, or the like.

Figure 5:
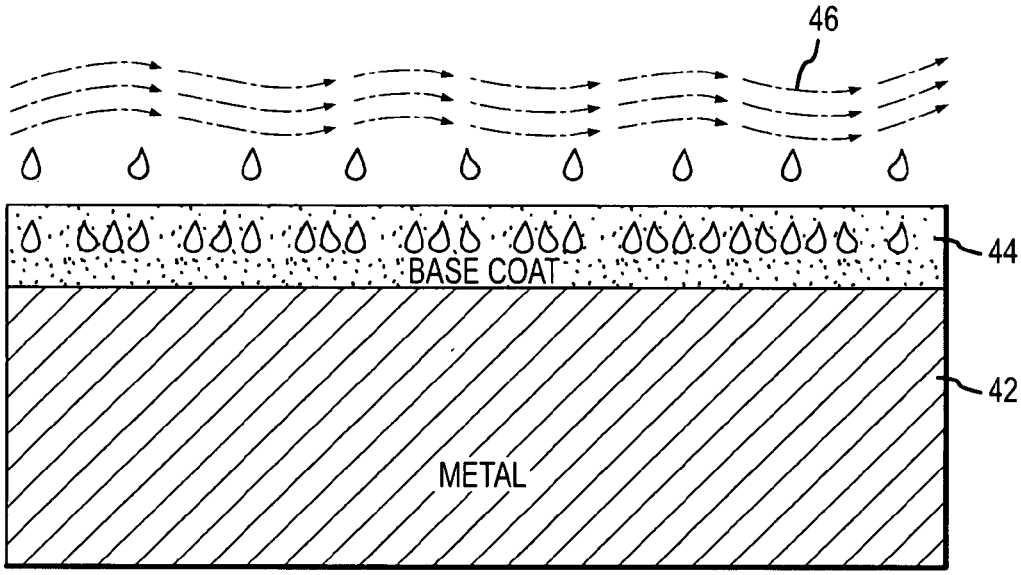
FIGS. 5–7 illustrate a paint drying process according to the invention.
Figure 6:
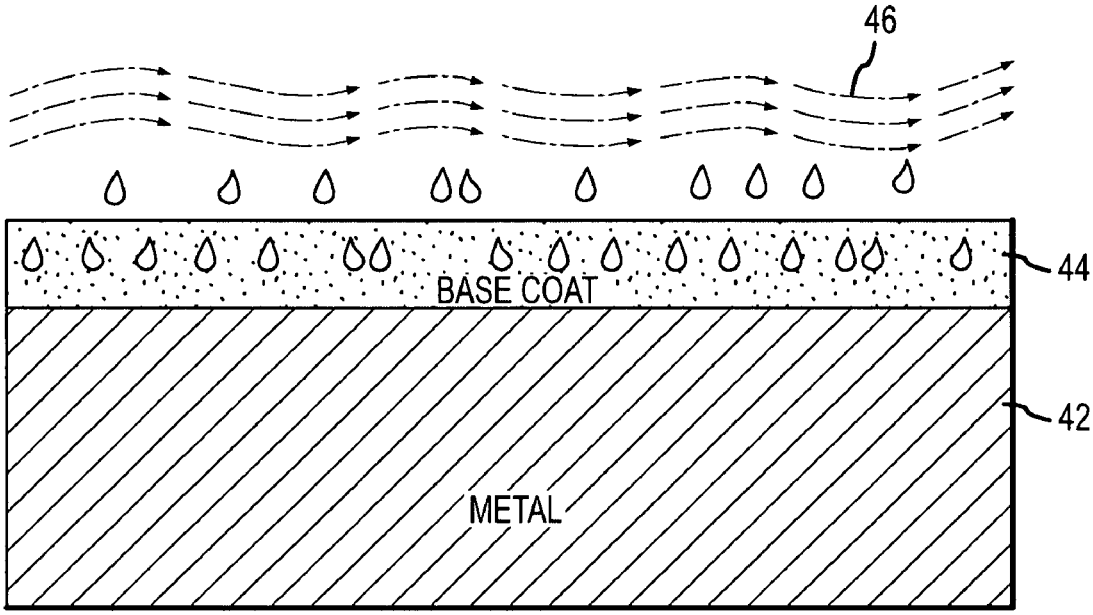
Figure 7:
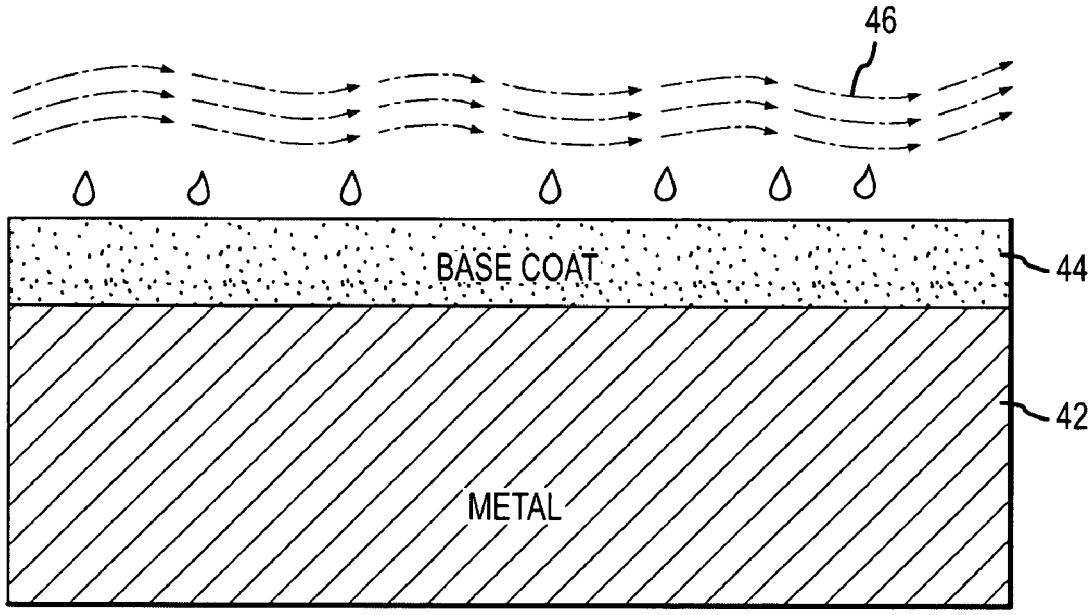

FIGS. 5–7 illustrate the process of drying a waterborne base coat using the techniques of the invention. In FIG. 5, a metal object 42 is sprayed with a base coat 44. The substantially increased airflow around the vehicle is illustrated by contours 46. This occurs during the "DRY" cycle of the painting process for waterborne refinish products.

As shown in FIG. 6, the more rapidly the water is evaporated from the surface of the newly sprayed metal object 42, the more rapidly the coat 44 is cured, allowing the next coat to be applied. By increasing evaporation, the water evaporates rather than remaining on object 42. In this way, more water may come out of coat 44 as illustrated in FIGS. 6 and 7. Although possible, it is not necessary to dry the waterborne base coat in the bake cycle. Curing occurs via evaporation, and that is accomplished with air movement.

EXAMPLE

One non-limiting example of how the techniques of the invention may be used to increasing drying and curing times is set forth below. The example utilized a Garmat USA, Inc. PPG Envirobase Waterborne Base with DC3000 High Velocity Clearcoat. The spray booth was a Garmat USA, Inc. 3000 series paint spray booth (available from Garmat USA, Inc.) fitted with the three 24 inch diameter aluminum blade propeller fans similar to the embodiment in FIGS. 2–4.

The booth was set to 72 F. and 0.02" W.C. A 2002 Buick Century was used for the test. The first coat of base was applied medium wet with the timing beginning as soon as the spraying began. The roof of the car was sprayed. The waterborne base coat completely flashed off in 5.46 minutes without the use of the propeller fans.

The second coat of base was applied, medium wet, and the three fans were rotated during spraying at about 750 rpm, and raised to about 1050 rpm for the dry phase. The waterborne base completely flashed off in 3.38 minutes from the time that the spraying began.

A third coat of waterborne base was applied medium wet with the paint gun adjusted for a wider fan pattern. The waterborne base completely flashed off in 2.23 minutes from the time the spraying began.

The paint spray booth was set to 78 F. and the process was moved to the hood, fender, and front bumper of the car. The first coat of the water base was applied medium wet with the fans running at a low speed (about 750 rpm). The vertical surfaces of the car flashed within seconds of the spray application being completed, and the fans were set to full speed (about 1050 rpm). The front of the car was completely flashed off in 3.30 minutes from the time that the spraying began.

A second coat of the base was applied Wet with the fans running at low speed. Again the vertical surfaces flashed off within seconds of the spray application being completed. The fans were set to high speed at the end of the spray application and the front of the car was completely flashed off in 4.27 minutes from the time that the spraying began.

Two medium wet coats of the DC3000 clear were applied in immediate succession. The booth was set to bake with no Purge Cycle time, 185 F. for a 5 minute Ramp Up Cycle, 170 F. for a 5 minute Ramp Down Cycle, and 140 F for a 10 minute Bake Cycle.

The desired 120 F surface temperature was achieved in 4 minutes with the fans running at about 1050 rpm).

Air speed measurements were made during the Bake Cycle around the front of the car without the fans running. At the right front fender belt line the air speed was 83 feet per minute. At the front of the car there was 189 FPM, 88 FPM at the left front fender, and 77 FPM at the left front door. All measurements were made at the belt line of the car.

The fans were set to full speed during the Bake Cycle and the air speed measurements were repeated. There was 204 FPM at the right front fender, 241 FPM at the front of the car, 256 FPM at the left front fender, and 371 FPM at the left front door. The clear coat was dry to the touch after the Ramp Up and Ramp Down Cycles were completed.

The invention has now been described in detail for purposes of clarity and understanding. However, it will be appreciated that certain changes and modifications may be practiced within the scope of the appended claims.

What is claimed is:

1. A system comprising:

a housing having a ceiling and at least one side wall that define an interior for holding an object to be sprayed or cured;

a pressurized air plenum disposed above the ceiling that is adapted to supply air into the interior;

a ceiling filter media disposed to filter air from the plenum and into the interior;

at least one fan disposed in the interior below the filter media, wherein the at least one fan is operable to locally increase air flows within the interior in the vicinity of the object to increase evaporation rates associated with a spray application on the object, and to enhance air flow over the object during a dry or a cure cycle; and wherein the at least one fan is coupled directly under the ceiling filter media.

2. A system as in claim 1, wherein the at least one fan has a low speed setting and a high speed setting.

3. A system as in claim 2, wherein the speed at the low setting is about 750 RPM and the speed at the high setting is about 1050 RPM.

4. A system as in claim 1, further comprising an air motor or an electric motor to drive the at least one fan.

5. A system as in claim 1, further comprising at least one exhaust opening that is adapted to exhaust air from the interior.

6. A system as in claim 5, wherein the at least one exhaust opening is positioned in a floor disposed beneath the housing.

7. A system as in claim 5, wherein the at least one exhaust opening is positioned in towers or in the at least one side walls.

8. A system as in claim 1, wherein the air plenum is configured to distribute air across substantially all of the ceiling.

9. A system as in claim 1, wherein the at least one fan comprises three fans.

10. A system as in claim 1, wherein the at least one fan is configured to produce air flow rates in the range from about 200 feet per minute to about 350 feet per minute.

11. A system as in claim 1, wherein the at least one fan is configured to produce a flow rate over object is about 100% to about 150% greater than the rest of the interior of the housing.

12. A system for spraying or curing objects, the system comprising:

a structure having a ceiling and at least one side wall that define an interior for holding an object to be sprayed or cured;

a pressurized air plenum disposed above the ceiling that is adapted to supply air into the interior;

a ceiling filter media disposed to filter air from the plenum and into the interior; a plurality of fans disposed in the interior below the filter media, wherein each fan is operable to locally increase air flows within the interior in the vicinity of the object to increase evaporation rates associated with a spray application on the object, and to enhance air flow over the object during a dry or a cure cycle, and wherein the fans are coupled directly under the ceiling filter media; and a plurality of motors that are configured to drive the fans.

* * * * *

US007045013C1

(12) EX PARTE REEXAMINATION CERTIFICATE (8752nd)

United States Patent

DeRegge

(10) Number: US 7,045,013 C1

(45) Certificate Issued: Dec. 13, 2011

(54) SPRAY BOOTH SYSTEMS AND METHODS FOR ACCELERATING CURING TIMES

(75) Inventor: Karel DeRegge, Morrison, CO (US)

(73) Assignee: Garmat USA, Englewood, CO (US)

Reexamination Request:
No. 90/011,737, Jun. 10, 2011

Reexamination Certificate for:

| | |
|---|---|
| Patent No.: | **7,045,013** |
| Issued: | **May 16, 2006** |
| Appl. No.: | **10/956,580** |
| Filed: | **Oct. 1, 2004** |

Related U.S. Application Data

(60) Provisional application No. 60/530,780, filed on Dec. 17, 2003, and provisional application No. 60/526,924, filed on Dec. 3, 2003.

(51) Int. Cl.

| | |
|---|---|
| ***B05B 15/12*** | (2006.01) |
| ***B05C 15/00*** | (2006.01) |
| ***F26B 21/06*** | (2006.01) |

(52) U.S. Cl. ..... 118/326; 118/DIG. 7; 34/82; 454/52

(58) Field of Classification Search ..... None
See application file for complete search history.

(56) References Cited

To view the complete listing of prior art documents cited during the proceeding for Reexamination Control Number 90/011,737, please refer to the USPTO's public Patent Application Information Retrieval (PAIR) system under the Display References tab.

*Primary Examiner*—Terrence Till

(57) ABSTRACT

One embodiment of the invention provides a spray booth that comprises a spray booth housing having a ceiling and side walls that define an interior for holding an object to be sprayed. A presssurized air plenum is disposed above the ceiling and is adapted to supply air into the interior. A filter media is used to filter air from the plenum before entering into the interior. At least one fan is disposed in the interior below the filter media. The fan is operable to locally increase air flows in the vicinity of the object to increase evaporation rates associated with a spray application on the object, and to enhance air flow over the object during a dry or a cure cycle.

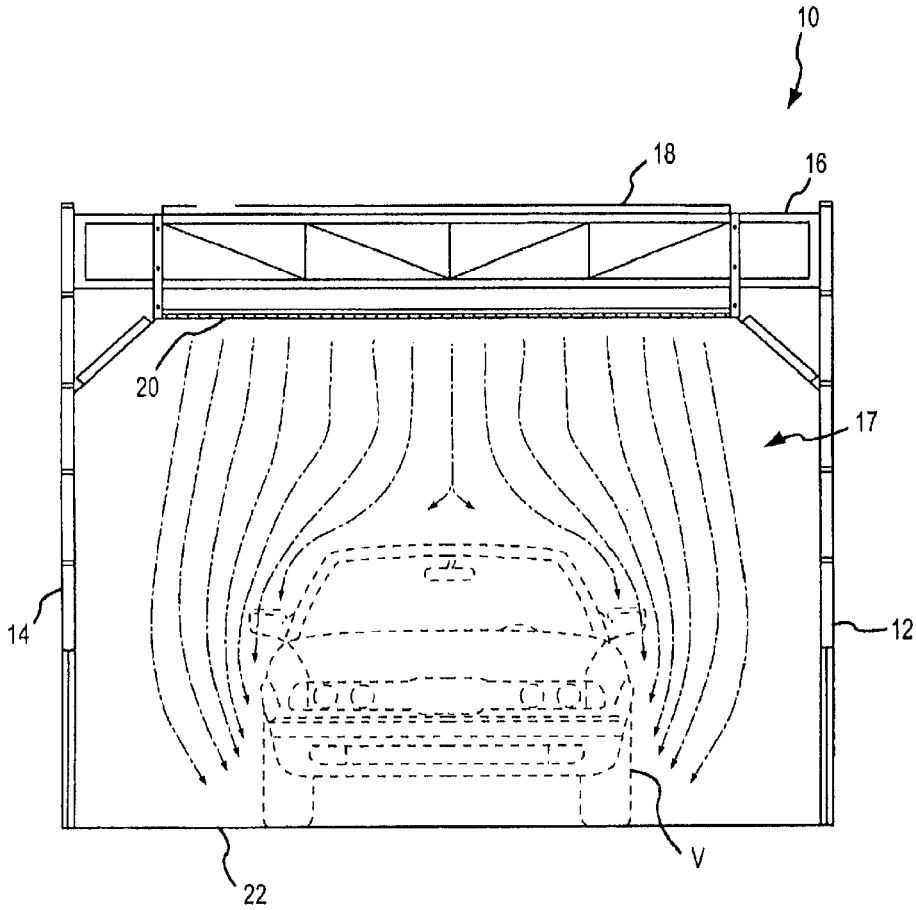

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-12 is confirmed.

New claim 13 is added and determined to be patentable.

*13. A system comprising:*

*a housing having a ceiling and at least one side wall that define an interior for holding an object to be sprayed or cured;*

*a pressurized air plenum disposed above the ceiling that is adapted to supply air into the interior; a ceiling filter media disposed to filter air from the plenum and into the interior, wherein the ceiling filter media extends along at least a majority of the ceiling;*

*at least one fan disposed in the interior below the filter media, wherein the at least one fan is operable to locally increase air flows within the interior in the vicinity of the object to increase evaporation rates associated with a spray application on the object, and to enhance air flow over the object during a dry or a cure cycle; and*

*wherein the at least one fan is coupled directly under the ceiling filter media.*

* * * * *